US006305752B1

(12) United States Patent
McGowan

(10) Patent No.: US 6,305,752 B1
(45) Date of Patent: Oct. 23, 2001

(54) PNEUMATIC BLASTING DEVICE

(76) Inventor: Alan Colin McGowan, 2 Holly Lane, Godalming, Surrey, GU7 2LP (GB)

( * ) Notice: Subject to any disclaimer, the term of this patent is extended or adjusted under 35 U.S.C. 154(b) by 0 days.

(21) Appl. No.: 09/254,508

(22) PCT Filed: Sep. 4, 1997

(86) PCT No.: PCT/GB97/02363

§ 371 Date: Mar. 5, 1999

§ 102(e) Date: Mar. 5, 1999

(87) PCT Pub. No.: WO98/10169

PCT Pub. Date: Mar. 12, 1998

(30) Foreign Application Priority Data

Sep. 6, 1996 (GB) ..... 9618596
Apr. 3, 1997 (GB) ..... 9708864

(51) Int. Cl.[7] ..... E21C 37/14
(52) U.S. Cl. ..... 299/21; 102/328
(58) Field of Search ..... 299/16, 21; 102/328; 166/177.5

(56) References Cited

U.S. PATENT DOCUMENTS 2,636,437 * 4/1953 Loving ..... 102/328
3,018,731 1/1962 Filstrup ..... 102/328
3,172,361 3/1965 Thouzeau ..... 102/328
4,301,731 11/1981 Fitzgerald ..... 299/21

FOREIGN PATENT DOCUMENTS 564144 2/1958 (BE) .
1298483 7/1969 (DE) .
3610149 10/1987 (DE) .
1208365 10/1970 (GB) .
2124681 * 2/1984 (GB) ..... 299/16 X
WO 94/03707 2/1984 (WO) .

OTHER PUBLICATIONS

PTO translation of Auslegeschrift 1298483; PTO 2000–3253, Jul. 2000.*

* cited by examiner

*Primary Examiner*—David Bagnell
*Assistant Examiner*—John Kreck
(74) *Attorney, Agent, or Firm*—Kinney & Lange, P.A.

(57) ABSTRACT

A compressed air blasting device (1), insertable in a pre-prepared bore, has a cylindrical housing or tube (2) containing a number of air guns (4). Apertures (3) in the housing (2) direct the flow of compressed air exhausted by the air guns (4) so as to produce a build-up of pressure sufficient to weaken and displace material from the area surrounding the bore. The further enhance the effect of the device (1), the bore may be filled with water and sealed with a packer (11) mounted on the device (1) prior to blasting.

10 Claims, 10 Drawing Sheets

PNEUMATIC BLASTING DEVICE

The present invention relates to a blasting device for use in rock blasting, particularly, although not exclusively, open cast mining.

Most conventional operations of rock blasting employ nitroprill as the explosive. Currently, in open cast mining, the blasting is carried out by firstly drilling a pattern of bores into a "bench" of rock to be blasted. Open cast mines are blasted in a step formation, the section of the step to be blasted being known as a "bench". Each bore is then loaded with the explosive, then the immediate area must be cleared of all personnel and machinery that could be damaged, before blasting may commence. After blasting, the area must be cleared of all rock and debris which could damage the machinery used on the site. In addition to the inherent dangers involved, these conventional methods of blasting have many drawbacks, including high labour costs in loading the holes, and high costs in the provision and transportation of the explosive used. The cessation of mining operations during blasting and clearing of the immediate area subsequent to the blasting, all add to the expense and time involved in such operations.

It is accordingly an object of the present invention to provide a device and method which at least partly overcomes the above-mentioned drawbacks.

In accordance with a first aspect of the present invention there is provided a blasting device for connection to a source of compressed gas, the device being insertable in a previously prepared bore and comprising one or more air guns contained within a housing each air gun being provided with an associated aperture in the housing through which gas exhausted from the gun is directed at a high pressure and velocity to create a blasting effect.

Preferably, the housing is of tubular form having a plurality of apertures or exhaust ports arranged down one side thereof. A rubber-like sheath may be located within the housing with openings in register with the or each of said aperture(s). The apertures may be ovoid in shape although other shapes may be found suitable. In particular, it has been noted that a T-shaped aperture is advantageous in that it reduces the damping effect on the air gun caused by air being unable to escape rapidly enough from the air gun exhaust chamber.

In accordance with a further aspect of the invention there is provided a method of blasting, employing at least one blasting device as defined above, and in which a bore or an array of bores is drilled into a section to be blasted, said device is lowered into a bore and the air gun(s) fired, causing the compressed air from the source to be released from the gun(s) and pass through the aperture(s), to create a blasting effect on the section surrounding the bore.

In accordance with a still further aspect of the present invention, there is provided a blasting device as previously described for insertion in a previously prepared bore which device further includes at least one packer located at one end of the device, the arrangement being such that the packer forms a seal between the bore and the device so that liquid introduced into said bore before operation of the device is retained within the bore and thereby amplifies the blasting effect of the air gun(s) when fired.

Preferably the packer takes the form of an inflatable collar, whilst the liquid, conveniently water, is introduced to the bore via a cascade provided within the device. Advantageously, the cascade is positioned to ensure that liquid emerging from the cascade washes the housing in the region of the apertures to prevent the accumulation of debris from the bore reducing the efficiency of the device.

It will be recognised that the packer or packers may be positioned anywhere on the housing of the device to suit a particularly blasting technique. For example, where it is desired to blast rock away from the lower portion of a bench, a packer may further be fitted at the lower end of the device to retain liquid which would otherwise drain into the undercut portion of the bench.

In order to aid in understanding invention a number of embodiments thereof will now be described by way of example and with reference to the accompanying drawings, in which:

FIG. 1 is a cross-sectional side view of the blasting device according to the invention;

FIG. 1*a* is a cross-sectional side view of the blasting device lined with an elastomeric sheet-material according to the present invention;

FIG. 2 is an axial cross-section of the blasting device on line A—A of FIG. 1;

FIG. 2*a* is an axial cross-section of the blasting device on line A—A of FIG. 1A;

Figure 1:
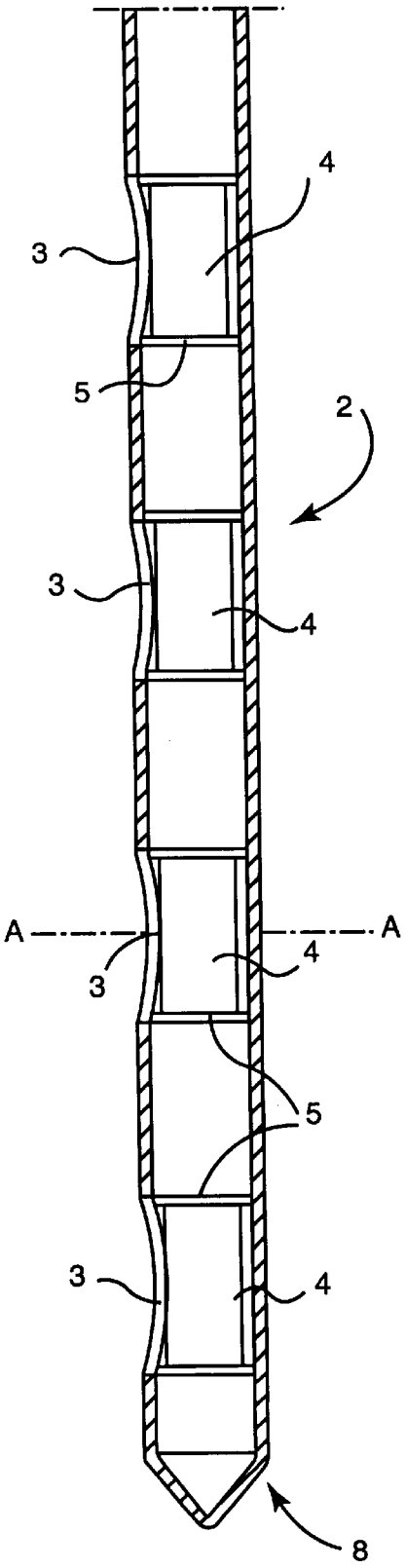
Figure 2:
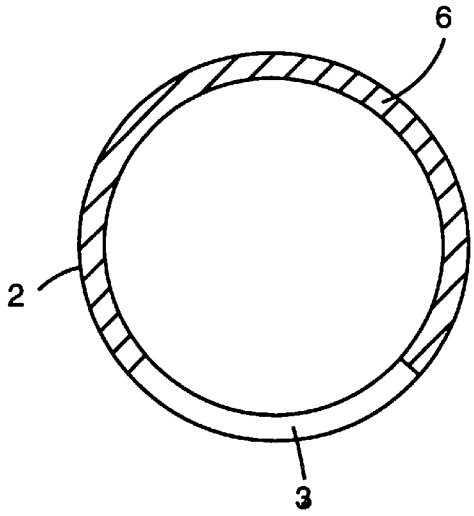
Figure 1A:
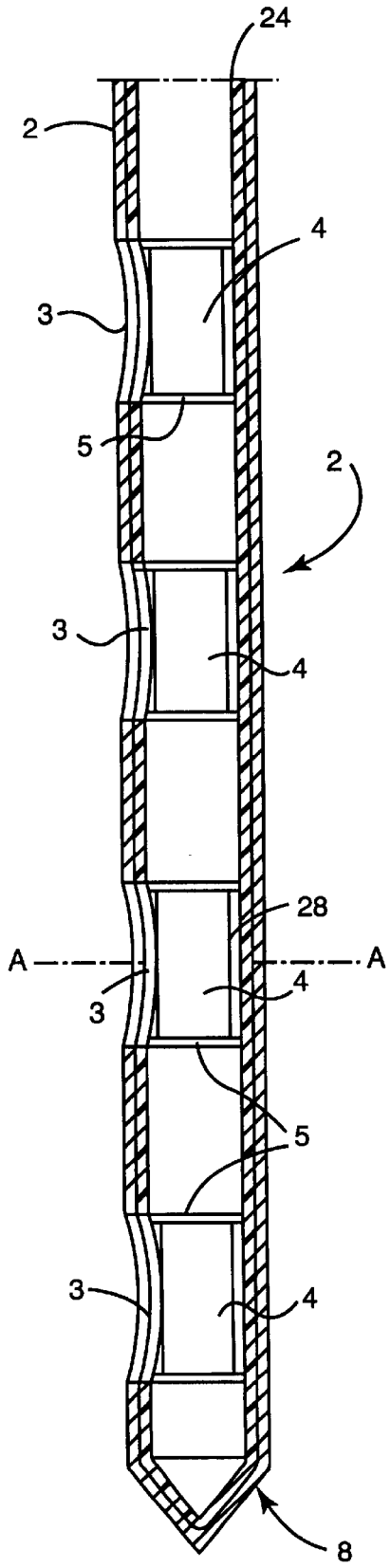
Figure 2A:
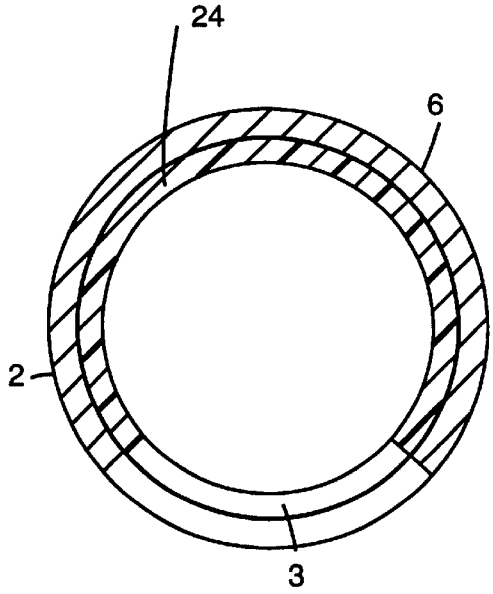
Figure 3:
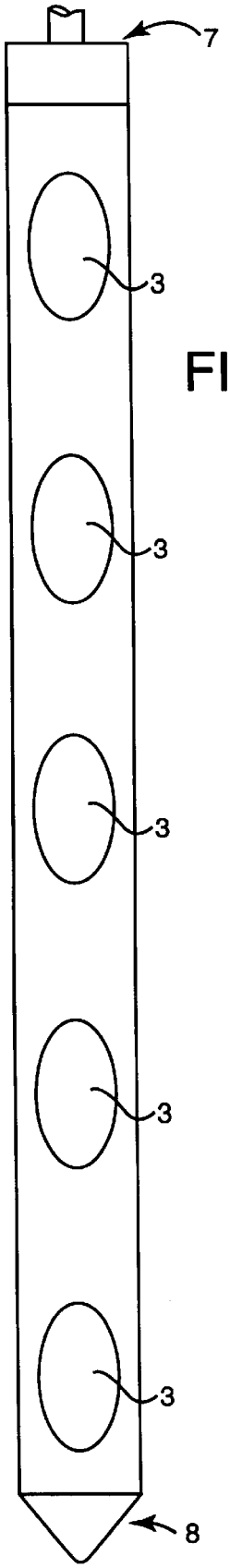
FIG. 3 is a view of the side down which apertures are arranged, being the front side of the device of FIG. 1.

Referring initially to FIGS. 1 to 5 of the drawings, the blasting device 1 comprises a housing, in this case a hot finished seamless tube (British Standard DIN 2448/1629 ST52 or equivalent) having a thickness of approximately 2 cm, and approximately 9 meters in length, and 15 to 20 cm in diameter. The tube has ovoid apertures 3 equally spaced down the front side, the apertures 3 having a maximum height of approximately 90 cm and a maximum width of approximately 15 cm. Individual air guns 4, suitably seismic guns of conventional construction, are positioned at each aperture of the tube, each gun 4 being approximately 90 cm in length. At the top and bottom of each gun 4 a circular plate 5, having a thickness of approximately 2 cm, is welded into position to occlude the tube 2. These plates 5 further serve to add rigidity to the tube and can provide support for the guns 4. Between the plates 5 on either side of a gun 4 is a dead space of approximately 90 cm of tube 2, and at both the top 7 and bottom 8 of the device 1 is a dead space of tube 2 of approximately 0.5 m. As shown in FIGS. 1*a* and 2*a*, an elastomeric sheet material 24 may be located within the housing 2 with openings in register with each of openings 3.

The bottom 8 of the tube below the lowest gun is tapered to facilitate entry of the device 1 into a drill hole. Air for the guns 4 is provided by a source of compressed air, suitably a compressor (not shown), which is connected by a suitable fitting to a manifold which feeds air to the air guns.

The air guns are charged prior to firing by air from the compressor, which air is held under pressure by a valve in each gun, until the valves are triggered to open simultaneously. The firing of the air guns 4 emits a blast of air from each gun, directed out of the apertures 3, in the form of concussive pressure. The plates 5 assist in focusing the concussive pressure created by the air out of the apertures 3.

The air line runs from the compressor, to provide the pressure of air required, for example 180 Bar, and enters the device at the fittings to pass into the sealed space at the top of the tube. The airline then passes down the internal face of the tube 2 on the side opposite the apertures 3, penetrating small sealed holes in each of the plates 5, and is arranged to distribute via a manifold (not shown) to each of the guns.

It will be appreciated by those skilled in the art that the device as described above is suitable for blasting a 9 m "bench" of rock. However, the device could be used for blasting almost any "bench" size by simple alteration of the length, width and number of guns involved, and could be produced in any of the larger diameter drilling sizes currently in use. Altering the shape of the apertures 3 and/or the separation between each gun could produce different blast effects, and the separation between each gun need not necessarily be regular.

Further, by suitable arrangement of air line connections, guns could be fired not only simultaneously, but also in series or a suitable pattern.

In use, in one particular (not illustrated) variant, the device is connected to a conventional drilling rig, with only slight modifications required for connection of the device to the rig such as a bracket. The drilling rig would carry the compressor which provides the pressure of air required to fire the guns. In the case of a 9 m "bench", the rig would require a 9 m support frame from which the device could be lowered into drilled holes.

In a further non-illustrated variant, the device is attached to the rig via a slide-on support frame. A winch connected by a cable to the connector at the top of the device enables the device to be lowered into the drilled bore and to slide off the support frame to allow the drilling rig to be backed off from the site of blasting, leaving the device still attached to the rig by the winch cable and air line. The guns are fired from a trigger on the rig and are therefore fired from a safe distance. After blasting is completed the rig could return and raise the device from the blasted site using the winch and slide on support frame. The drilling rig could additionally carry the device and, for simplicity, the drill could operate off the same compressor as the device. This would enable one rig to undertake the blasting of a "bench", from drilling the holes through to firing the guns. With the drill and device combined on one rig, the guns could be fired as the bores are drilled on a side-to-side basis.

Figure 4:
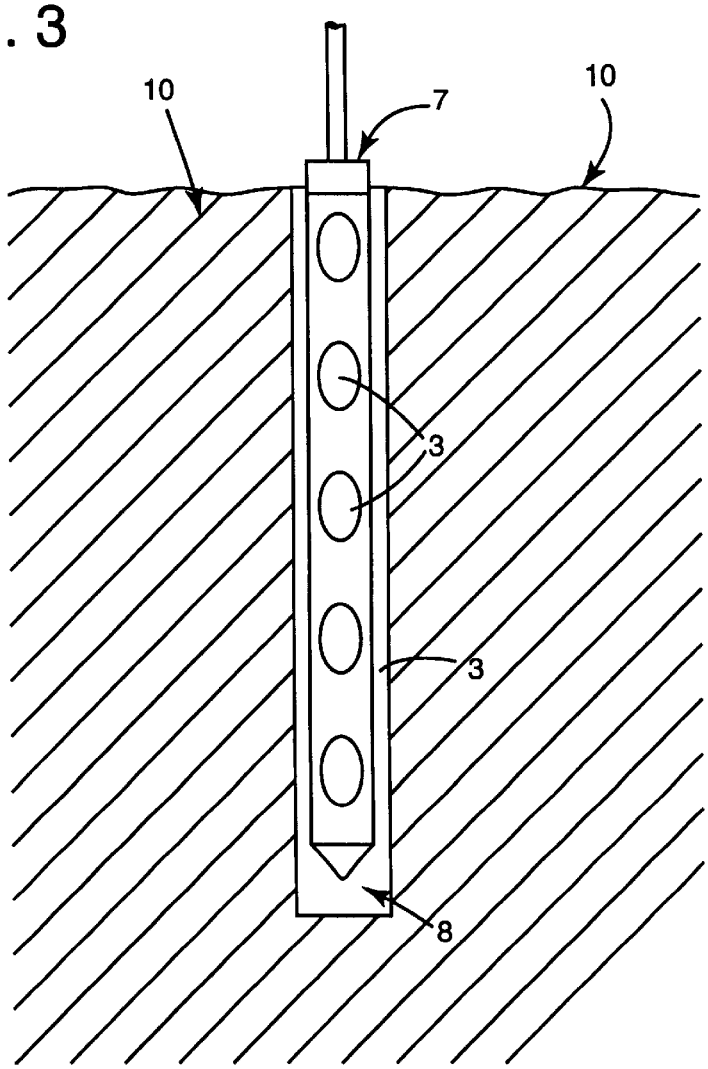
FIG. 4 is a view of the blasting device of FIG. 1, in situ for a blasting operation.

As illustrated in FIG. 4, the device would be positioned in a bore 9 so the front face of the device faces the section of the "bench" 10 to be blasted. The concussive pressure from the firing of the guns being directed out of the apertures 3 in the front side of the device.

Figure 5:
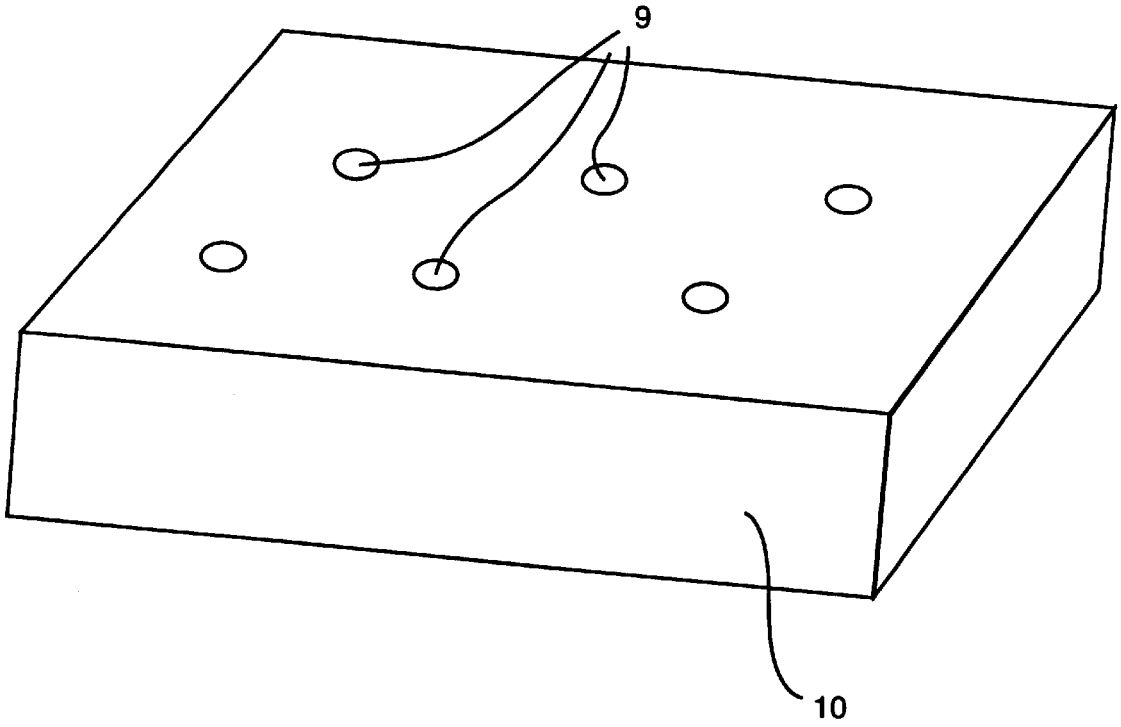
FIG. 5 is a diagrammatic view of a typical array of bores used for blasting a "bench"
Figure 6:
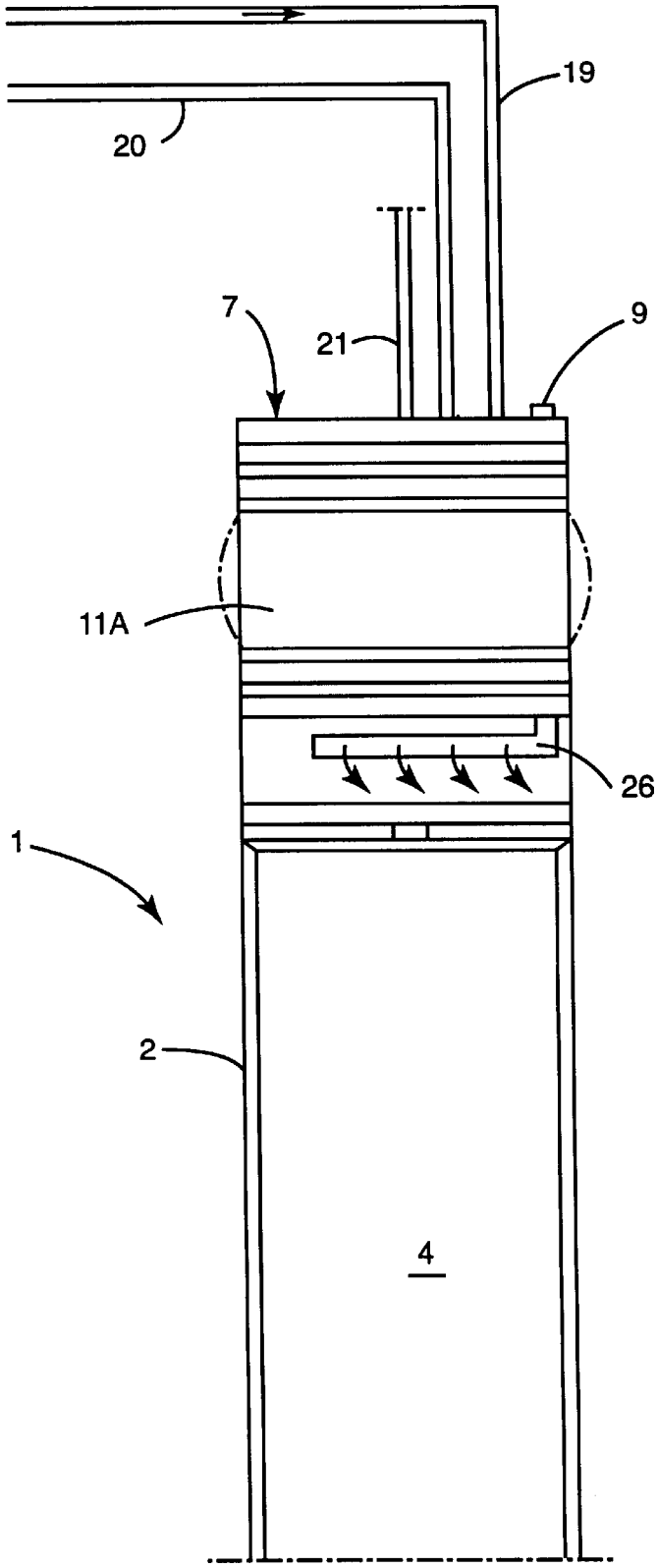
FIG. 6 is a side view of an upper portion of a device according a further embodiment of the invention.
Figure 7:
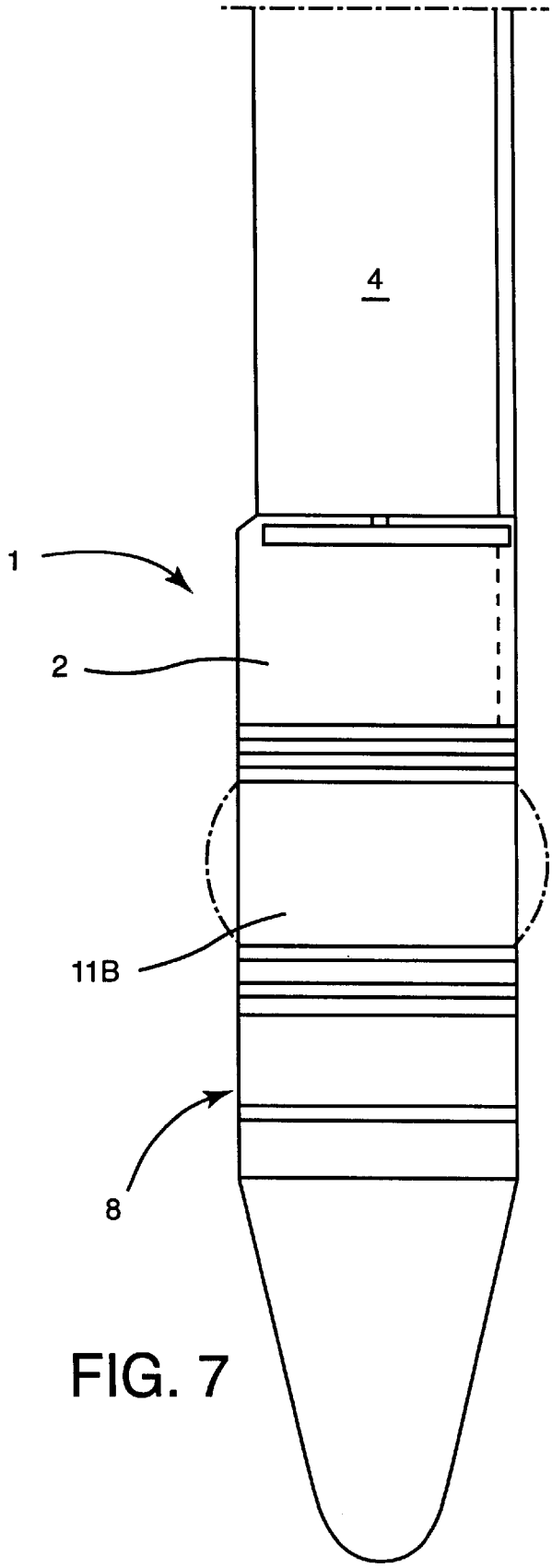
FIG. 7 is a similar view of a lower portion of the device of FIG. 6.
Figure 8:
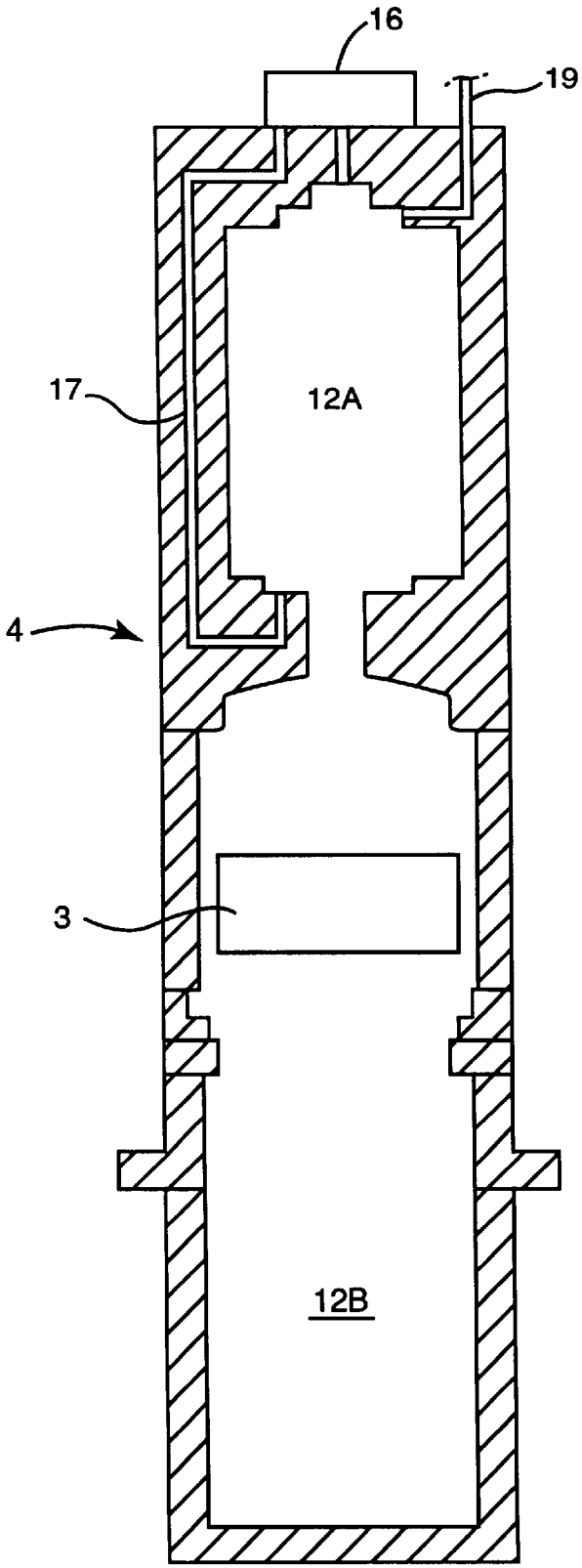
FIG. 8 is a detail cross-sectional side view of plan view of an aperture and air-gun of the device of FIG. 6 omitting the shuttle for clarity.
Figure 9:
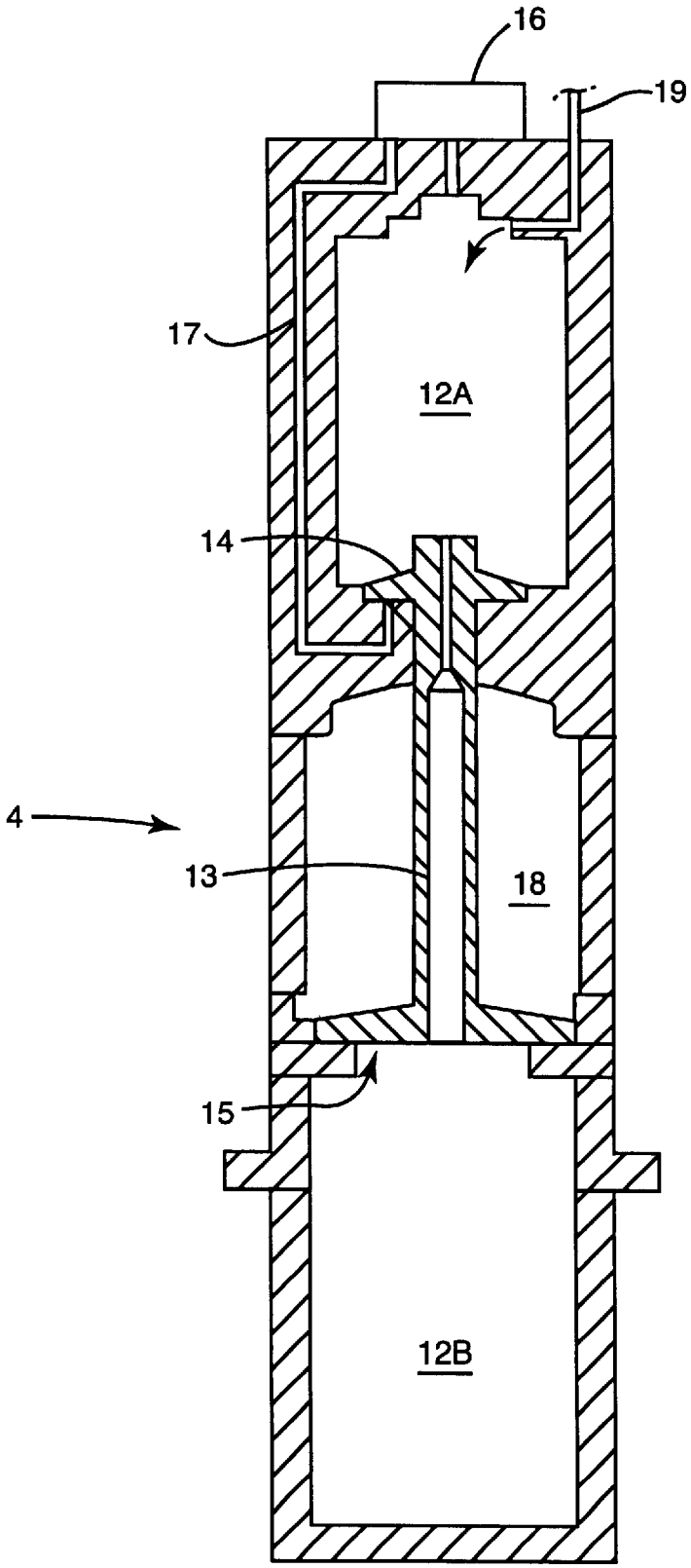
FIG. 9 is a similar view showing the air-gun in the armed position showing the shuttle.
Figure 10:
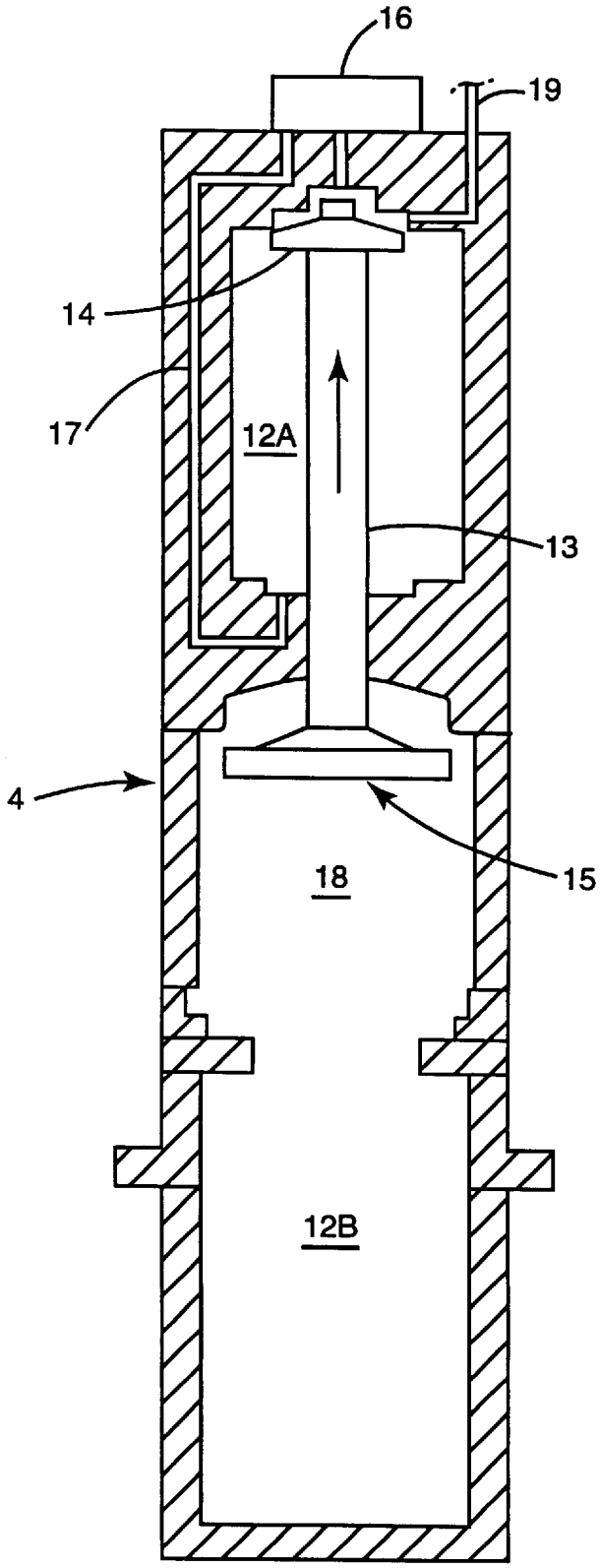
FIG. 10 is a similar view showing air-gun at the instant of maximum shuttle displacement after having been fired.

The pattern of bores 9 illustrated in FIG. 5 is similar to the pattern used for conventional mining operations. However, this array of bores would also provide the most efficient results for the use of the device according to this invention.

Referring now to the remaining FIGS. 6 to 11, in which corresponding items are identified by the same reference numerals as used above, there is shown a further embodiment of the blasting device 1. The device 1 comprises a housing, in this case a cylindrical metal tube 2 into which are fitted a set of air-guns 4 as shown in more detail in FIGS. 3 to 5. Each air-gun is positioned at an aperture 3 in the tube 2, the apertures 3 being arranged in the same plane. Compressed air is supplied to each airgun 4 via a manifold 19 within the housing as is electrical or other suitable firing cabling 20, for example fiber optic cabling. A water connection point 9 is provided at an upper end 7, in use, of the housing, which supplies a cascade 10 provided at the upper end 7 of the housing and hence above the apertures 3. The housing is further provided with upper and lower inflatable collars or packers 11*a,* 11*b* at respective ends 7, 8 of the housing. Conveniently, the packers 11*a,* 11*b* are inflated using the same air supply which feeds the air-guns 4.

In use, the device 1 is introduced into a previously prepared bore (not shown) whilst suspended on cable 21 and with each packer 11*a,* 11*b* deflated. Once in position within the bore, the packers 11*a,* 11*b* are inflated and water is introduced to the bore via the cascade 26. It will be noted that the water emerging from the cascade 26 passes down the tube 2 forming the housing and assists in removing debris from the region of the apertures 3. Water is supplied until the bore and voids 28 in the housing behind the apertures formed by each exhaust chamber 18 of the air-guns 4 are full. The device may then be operated by firing the air-guns.

Such air-guns 4 are conventional in that air enters and is stored in high pressure chambers 12*a,* 12*b* either side of the exhaust chamber 18. A shuttle 13, isolates the exhaust chamber 18 from the high pressure chambers 12*a*, 12*b* in the "armed" position. Air is released explosively from the high pressure chambers 12*a*, 12*b* by unseating a triggering piston 14 located at one end of the shuttle 13, via an air bleed line 17 under the control of a solenoid operated valve 16. By unseating the triggering piston 14, the air pressure acting on the larger area of a firing piston 15 displaces the shuttle 13 upwardly, against gravity, from its "armed" or seated position allowing the air to escape explosively into the water contained within the exhaust chamber 18 behind the single aperture or port 3. The resulting air bubble expands and then rapidly collapses such that the cavitation effect destroys the structure of the rock in the area of the device adjacent the apertures 3. In the case of underground versions of the device, a "bleed-off" valve would be fitted to allow displaced air to exit the drilling hole when operating horizontally.

Figure 11:
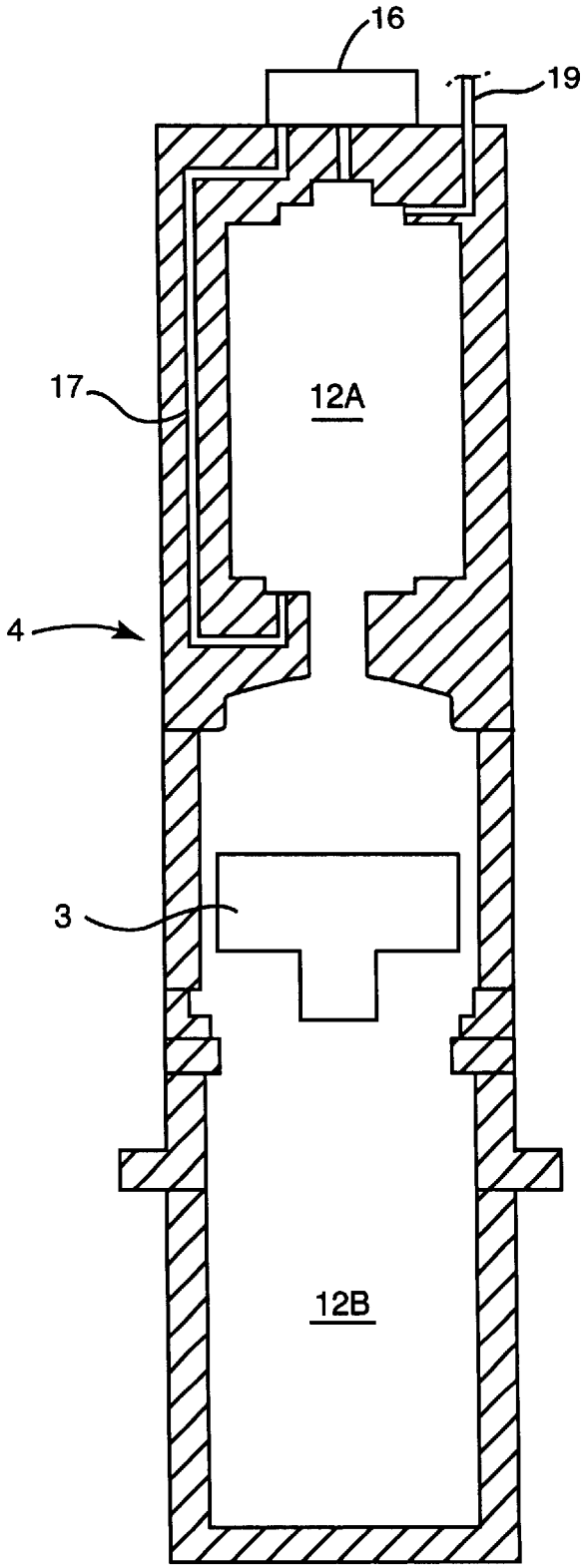
FIG. 11 is a similar view to that of FIG. 8 showing a variant of the aperture.

Finally, FIG. 11 shows a variant of the aperture described previously in which the aperture 3 is T-shaped. Such a shape permits air to escape from the exhaust chamber 18 of the air gun in a controlled manner such that the firing piston 15 is not retarded by the inability of the air to leave the exhaust chamber 18 rapidly enough.

It will be appreciated by those skilled in the art that the above embodiment may be further modified to improve both the effect and ease of operation of the above device. In respect of the latter point in particular, the packers may be inflated automatically on contact with water. Such a feature being particularly useful for the topmost packer which would provide an indication to the operator that the bore was full of liquid. Furthermore, to prevent liquid entering into the void region between the air-guns, the region could be filled with a suitable foam material.

Advantages of the device as described in accordance with the present invention include that it is re-usable while explosives are not, the inventive device should not create any flying debris, there would be no explosives vehicles to maintain and crew and no clean-up operation; only one operator could be required, time can be saved, and risk of "fracture" headaches due to contact with nitroglycerine is avoided, seismic guns would be pollution-free and many land-drilling rigs currently in use could be adapted to take one of the devices. The absence of explosive charges also reduces noise pollution considerably, and efficiently designed embodiments of the invention are capable of near silent operation.

It will also be understood that various alterations and modifications may be made to the above embodiments without departing from the scope of the invention. An example of how the above embodiment could usefully be modified would be to add a further aperture or series of apertures on the reverse side of the tube 2, ie facing the substantially opposite direction to the existing apertures 3. This would give a balanced blast and could thereby alleviate recoil of the device 1. This in turn may be beneficial in terms of the service life of the device.

The invention is further applicable to other applications including other forms of blasting. For instance, the device could be used in demolition operations. Furthermore, where a greater depth of material requires blasting, two or more of such devices could be coupled together in the same bore, in which case, for convenience, the rig might carry more than one device. In certain applications, for instance the extinguishing of an oil/gas well fire, instead of utilising compressed air the device may be charged with an inert gas or gases which, when explosively released by the air gun or guns, both suppress and extinguish the fire.

It will additionally be noted that whereas in conventional mining operations, all the bores are drilled, then the explosives are loaded and blasted simultaneously. With the present invention it may be more efficient to drill a bore, then fire that bore with the device before drilling subsequent bores in that "bench". This would prevent the firing of one bore fracturing a bore already drilled, and so restricting subsequent entry of the device.

What is claimed is:

1. A blasting device for connection to a source of compressed gas, the device being insertable in a previously prepared bore, the device comprising;

an elongate housing having one or more apertures on a sidewall, one or more air gun within the elongate housing, each air gun comprising:

a high pressure chamber;

an exhaust chamber, the exhaust chamber being in intermittent fluid communication with the high pressure chamber; and a repeatably moveable shuttle, the repeatably moveable shuttle alternating between a sealed position and a discharge position, the sealed position allowing fluid pressure to increase in the high pressure chamber and the discharge position permitting fluid to discharge through the exhaust chamber;

at least one packer located at one end of the elongate housing, each air gun being associated with an aperture on the side wall of the elongate housing, through which gas is exhausted upon firing of the air gun directed at a high pressure and velocity to create a blasting effect; and the packer being arranged to form a seal between the housing and a surrounding bore so that liquid introduced into said bore before firing of the air gun is retained within the bore and thereby amplifies the blasting effect of the air gun(s) when fired.

2. A device as claimed in claim 1, wherein the compressed gas is air.

3. A device as claimed in claim 1, wherein the housing is tubular in form.

4. A device as claimed in claim 1, wherein the housing is lined with an elastromeric sheet material.

5. A device as claimed in claim 1, wherein a plurality of apertures are arranged on one side of the housing.

6. A device as claimed in claim 1, wherein the apertures are elliptical in shape.

7. A device as claimed in claim 1, wherein the apertures are T-shaped.

8. A device as claimed in claim 1, wherein the packer takes the form of an inflatable collar.

9. A device as claimed in claim 1, further including a cascade to deliver liquid into the bore.

10. A method of blasting, the method comprising:

drilling a bore or an array of bores into a section to be blasted;

lowering a blasting device into a bore the blasting device comprising:

a source of compressed gas;

an elongate housing in fluid communication with the source, having one or more apertures on a sidewall, one or more air guns within the elongate housing, each air gun comprising:

a high pressure chamber;

an exhaust chamber, the exhaust chamber being in intermittent fluid communication with the high pressure chamber; and a repeatably moveable shuttle, the repeatably moveable shuttle alternating between a sealed position and a discharge position, the sealed position allowing fluid pressure to increase in the high pressure chamber and the discharge position permitting fluid to discharge through the exhaust chamber;

at least one packer located at one end of the elongate housing, each air gun being associated with one of the apertures on the side wall of the elongate housing, through which gas is exhausted upon firing of the air gun directed at a high pressure and velocity to create a blasting effect; and the packer being arranged to form a seal between the housing and a surrounding bore so that liquid introduced into said bore before firing of the air gun is retained within the bore and thereby amplifies the blasting effect of the air gun(s) when fired;

introducing a liquid into the bore around the device, the liquid at least partially filling the bore hole and flowing into the apertures of the blasting device;

firing the air gun(s), causing the compressed air from the source to be released from the gun(s) and to be passed through the liquid and through the aperture(s), to create a blasting effect on the section surrounding the bore; and removing the blasting device with the air gun intact, the air gun being repeatably fireable.

* * * * *